US007143892B2

(12) United States Patent
Kolton et al.

(10) Patent No.: US 7,143,892 B2
(45) Date of Patent: Dec. 5, 2006

(54) HANGER FOR JEWELRY AND THE LIKE

(75) Inventors: Chester Kolton, Westfield, NJ (US); Michael Norman, East Brunswick, NJ (US)

(73) Assignee: B&G Plastics, Inc., Newark, NJ (US)

( * ) Notice: Subject to any disclaimer, the term of this patent is extended or adjusted under 35 U.S.C. 154(b) by 350 days.

(21) Appl. No.: 10/640,559

(22) Filed: Aug. 13, 2003

(65) Prior Publication Data

US 2005/0035004 A1 Feb. 17, 2005

(51) Int. Cl.
*A45C 11/04* (2006.01)

(52) U.S. Cl. ..... 206/6.1; 206/566; 206/523; 206/806; 206/476; 206/784; 206/486

(58) Field of Classification Search ..... 206/6.1, 206/525, 525.1, 784, 476, 486, 775–783, 206/806

See application file for complete search history.

(56) References Cited

U.S. PATENT DOCUMENTS

| | | | | | |
|---|---|---|---|---|---|
| 777,823 | A | * | 12/1904 | Webster et al. | 206/486 |
| 1,240,671 | A | * | 9/1917 | Catala | 206/754 |
| 1,896,678 | A | * | 2/1933 | Myers | 206/476 |
| 2,944,665 | A | * | 7/1960 | Obeck | 206/361 |
| 3,009,622 | A | * | 11/1961 | Leone | 206/485 |
| 3,658,175 | A | * | 4/1972 | Vrana | 206/780 |
| 3,769,741 | A | * | 11/1973 | Hessler et al. | 43/57.1 |
| 3,847,282 | A | * | 11/1974 | Collura et al. | 206/782 |
| 5,381,891 | A | * | 1/1995 | Harris | 206/197 |
| 5,915,564 | A | * | 6/1999 | Hsi-Chang | 206/784 |
| 6,073,758 | A | | 6/2000 | Webster et al. | |

* cited by examiner

*Primary Examiner*—Jila M. Mohandesi
(74) *Attorney, Agent, or Firm*—Hoffmann & Baron, LLP

(57) ABSTRACT

A hanger for jewelry includes a substrate having first and second end portions and first and second interior portions, the first end portion being foldable relative to the first interior portion, the second end portion being foldable relative to the second interior portion, the first and second interior portions being foldable relative to one another. In assembled form, a hanger comprises a substrate having first and second upstanding end portions and first and second upstanding interior portions and defining a first fold line between the first end portion and the first interior portion, a second fold line between the second end portion and the second interior portion and a third fold line between the first and second interior portions, the third fold line being disposed upwardly of the first and second fold lines.

14 Claims, 3 Drawing Sheets

HANGER FOR JEWELRY AND THE LIKE

FIELD OF THE INVENTION

This invention relates generally to jewelry hangers and pertains more particularly to hangers for looped jewelry, such as necklaces.

BACKGROUND OF THE INVENTION

U.S. Pat. No. 6,073,758 discloses a hanger for looped jewelry comprised of an elongate web member having a resilient foam rubber pad secured thereto centrally of ends of the web member. Web member portions are defined adjacent the rubber pad and are foldable about a fold line formed in the web member centrally of the rubber pad after a looped jewelry, e.g., a necklace, is disposed in registry with the center of the rubber pad. Upon folding of the web member portions onto one another, the free ends thereof are secured to one another, retaining the necklace from movement relative to the rubber pad. The free ends of the web members define apertures, whereby the hanger may be releasably secured to a display rack.

The rubber pad defines a recess opening into a rear surface of the web member, whereby a clasp of the necklace may be seated in the recess and be visible exteriorly of the hanger.

SUMMARY OF THE INVENTION

The present invention has as its primary object the provision of a hanger for looped jewelry with facility for retention of looped jewelry thereby hung against movement relative to the hanger.

In attaining this and other objects, the invention provides a hanger for jewelry, comprising a substrate having first and second end portions and first and second interior portions, the first end portion being foldable relative to the first interior portion, the second end portion being foldable relative to the second interior portion, the first and second interior portions being foldable relative to one another.

The substrate defines openings therethrough extending from a fold line of the first and second interior portions and a necklace chain can be draped into the openings. A resilient pad adjacent first ends of the openings may further receive the necklace chain.

In another aspect, the invention provides a hanger for jewelry, comprising a substrate having first and second end portions and defining a fold line portion between the first and second portions, a resilient pad being disposed on the first and second portions and traversing the fold line portion, and aperture extending through one of the first and second end portions and spaced from an end of the resilient pad.

In a still further aspect, the invention provides a hanger for jewelry, comprising a substrate having first and second upstanding end portions and first and second upstanding interior portions and defining a first fold line between the first end portion and the first interior portion, a second fold line between the second end portion and the second interior portion and a third fold line between the first and second interior portions, the third fold line being disposed upwardly of the first and second fold lines.

The foregoing and other objects and features of the invention will be further understood from the following detailed description of preferred embodiments and practices and from the drawings wherein like components are identified by like reference numerals.

DETAILED DESCRIPTION OF PREFERRED EMBODIMENTS AND PRACTICES

Figure 1:
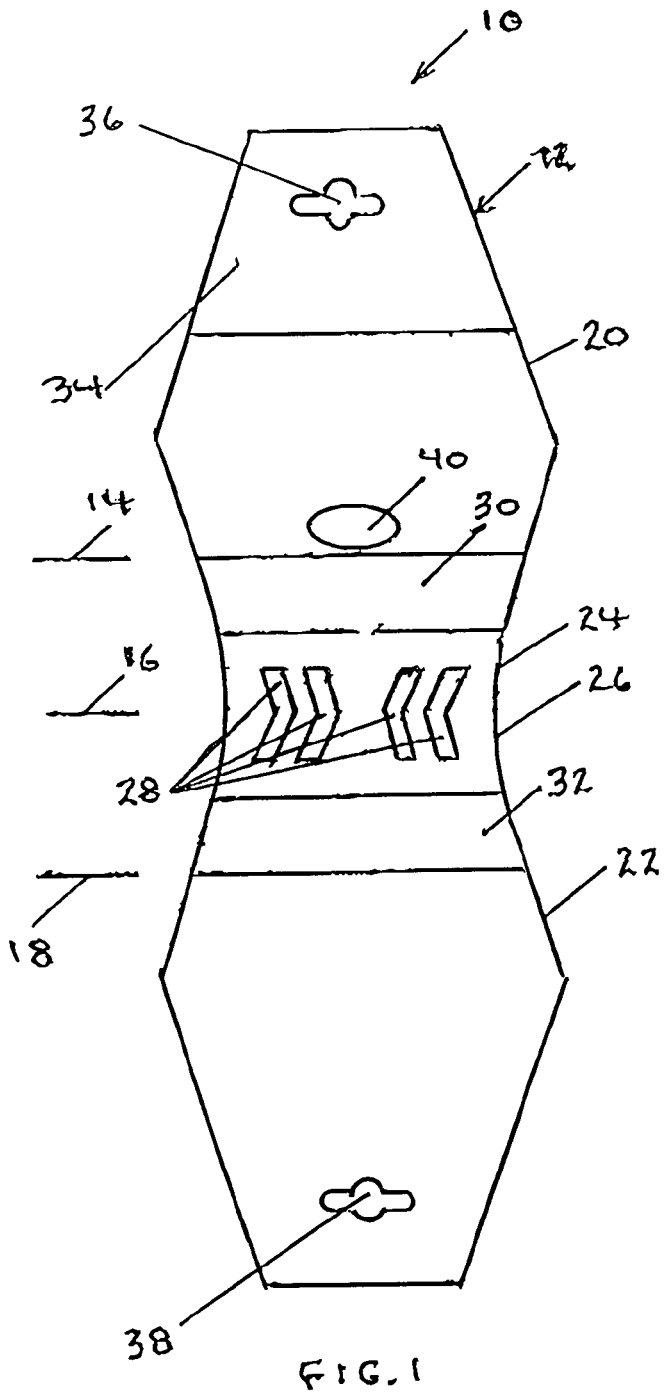
FIG. 1 is a plan elevation of a first embodiment of a jewelry hanger in accordance with the invention.
Figure 2:
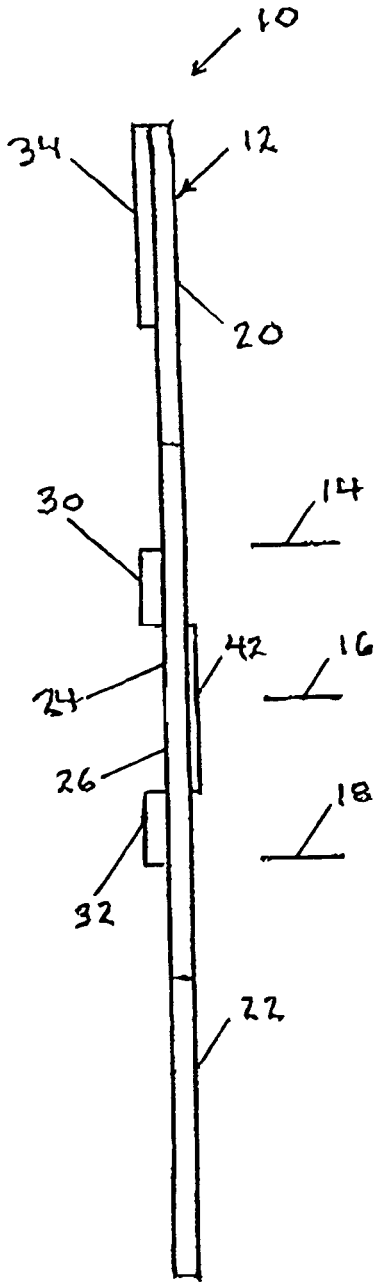
FIG. 2 is a right side elevation of FIG. 1.

Referring to FIGS. 1 and 2, hanger 10 for jewelry includes substrate 12, which may be comprised of cardboard or the like. Substrate 12 has fold lines 14, 16 and 18 transversely therein, dividing the substrate into first and second end portions 20 and 22 and first and second interior portions 24 and 26.

First end portion 20 is foldable relative to first interior portion 24. Second end portion 22 is foldable relative to second interior portion 26. First and second interior portions 24 and 26 are foldable relative to one another.

Substrate 12 defines openings 28 therethrough extending from fold line 16 into first and second interior portions 24 and 26.

First resilient pad 30 is secured to the upper surface of first interior portion 24, distal from ends of openings 28. Second resilient pad 32 is secured to the upper surface of second interior portion 26, also distal from ends of openings 28. The pads may be comprised of foamed plastic or rubber.

Adhesive 34 is disposed on first end portion 20. Hanging slot 36 extends through adhesive 34 and first end portion 20. Hanging slot 38 extends through second end portion 22. Aperture 40 extends through first end portion adjacent fold line 14.

Adhesive 42 is disposed on the undersurface of first and second interior portions 24 and 26.

Figure 3:
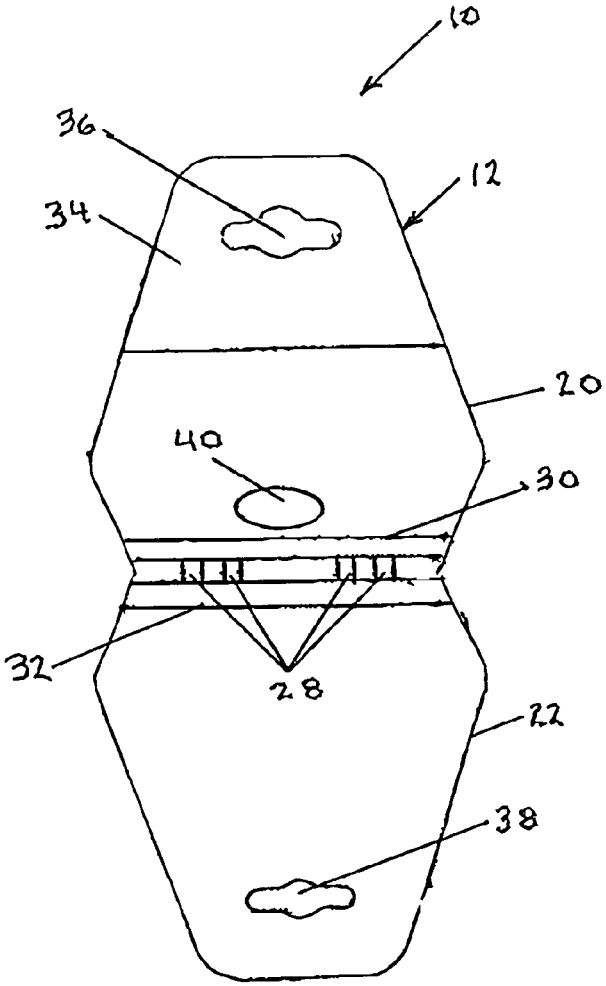
FIG. 3 is an elevational view of the FIG. 1 hanger in a first stage of assembly of the FIG. 1 hanger.
Figure 4:
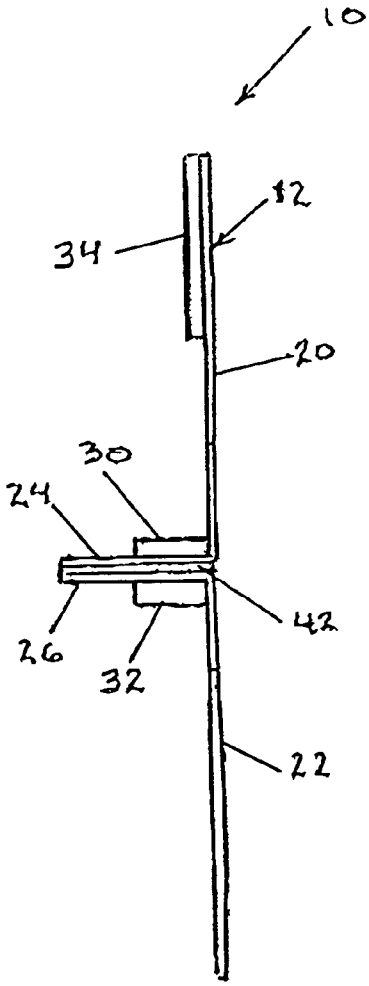
FIG. 4 is a right side elevation of FIG. 3.
Figure 5:
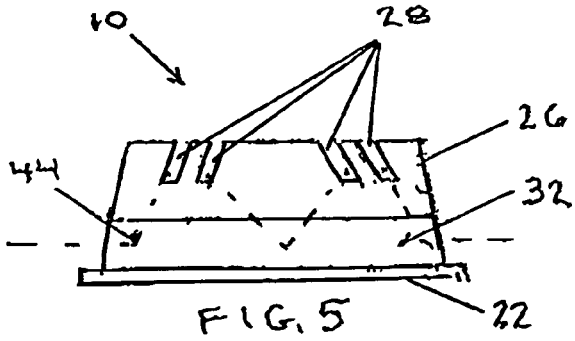
FIG. 5 is a front elevation of FIG. 4 with a necklace chain shown in broken lines.

Referring to FIGS. 3–5, hanger 10 is shown in a first stage of assembly. As illustrated, first and second interior portions 24 and 26 have been folded about fold line 16 and secured to one another by adhesive 42. Openings 28 open into the top of secured interior portions 24 and 26. Pads 30 and 32 are disposed below openings 28.

Necklace chain 44 is assembled with the first stage assembly of FIGS. 3–5 as shown in broken lines in FIG. 4. Preferably, chain 44 is draped into openings 28 and includes end courses 44*a* and 44*b* and middle course 44*c* in engagement with pad 32.

The assembly is completed by folding first end portion 20 upwardly about fold line 14 and by folding second end portion 22 upwardly about fold line 18 and securing the upper ends thereof to one another by adhesive 34.

As will be seen, the hanger of FIGS. 1–5, as fully assembled, comprises a substrate having first and second upstanding end portions and first and second upstanding interior portions and defining a first fold line between the first end portion and the first interior portion, a second fold line between the second end portion and the second interior portion and a third fold line between the first and second interior portions, the third fold line being disposed upwardly of the first and second fold lines. The substrate defines openings extending through and downwardly of the third fold line. The hanger further includes a first resilient pad disposed between the first exterior portion and the first interior portion and a second resilient pad disposed between the second exterior portion and the second interior portion, the first and second resilient pads being downwardly of the openings. An adhesive layer is disposed between and joins the first and second interior portions. A further adhesive layer is disposed between and joins upper ends of the first and second exterior portions.

The substrate defines an aperture through the first end portion adjacent the first fold line and first and second slots extending respectively through the first and second exterior portions and in registry with one another.

Figure 6:
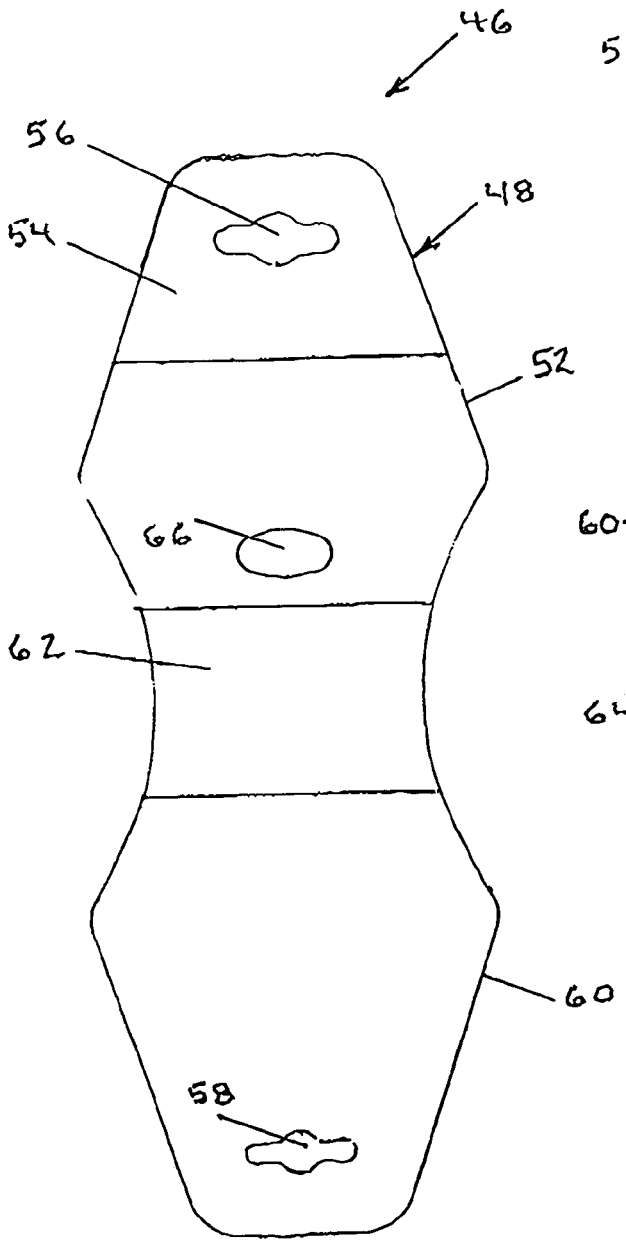
FIG. 6 is a plan elevation of a second embodiment of a jewelry hanger in accordance with the invention.
Figure 8:
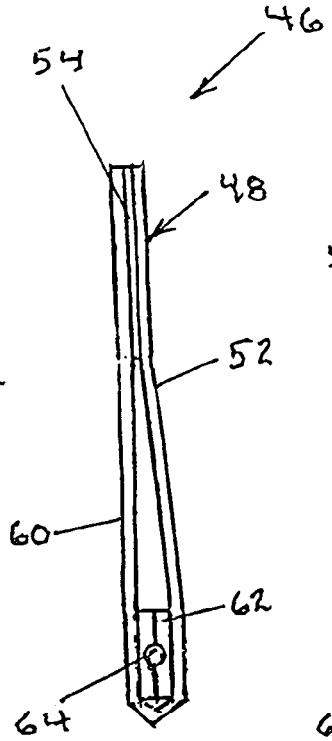
FIG. 8 is a side view of the hanger of FIG. 6 in assembled form with a necklace chain shown in broken lines.
Figure 7:
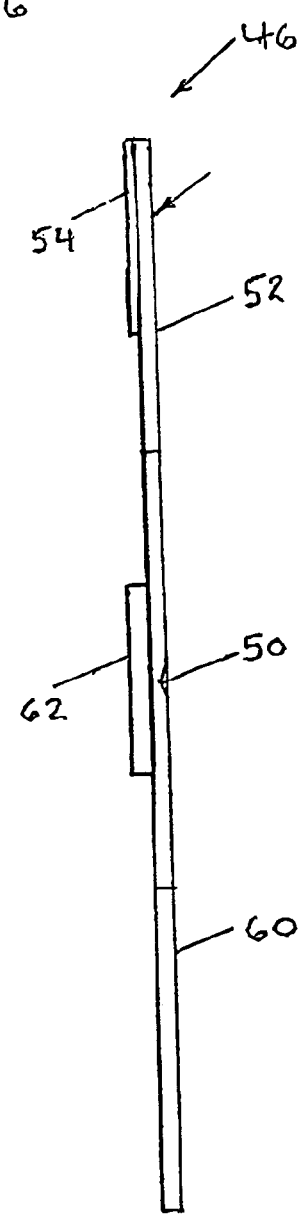
FIG. 7 is a right side elevation of FIG. 6.

Turning to FIGS. 6–8, hanger 46 includes substrate 48 which includes fold line 50. First substrate portion 52 includes adhesive 54 at its upper end. Hanging slot 56 extends through adhesive 54 and portion 52 and hanging slot 58 extends through portion second hanger portion 60. Resilient pad 62 extends across fold line 50 and is secured to substrate 48.

In assembled form of hanger 46, shown in FIG. 8, substrate portions 52 and 60 are folded about fold line 50, following insertion of necklace chain 64 therebetween between onto the center of pad 62, and are secured to one another by adhesive 54.

Aperture 66 is formed in substrate portion 52 aside pad 62 and, where the necklace chain includes a clasp, the clasp is seated in aperture 66. This is the case also for aperture 40 of FIG. 1.

Figure 9:
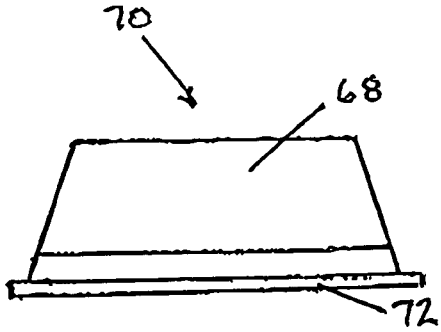
FIG. 9 is a repeat showing of FIG. 5 with a modified version of the substrate and resilient pad of FIG. 5.

FIG. 9 is a repeat showing of FIG. 5 with a modified version of the substrate and resilient pad of FIG. 5. Here, pad 68 of hanger 70 is configured as in FIGS. 6–8 , i.e., extending across fold line 16. Openings 28 are not formed in substrate 72.

Figure 10:
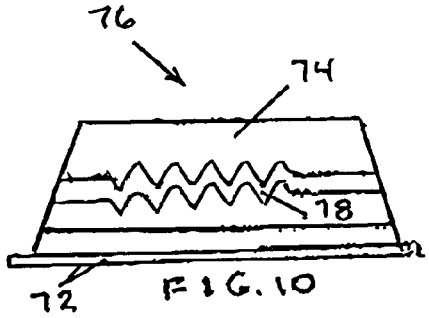
FIG. 10 is a further repeat showing of FIG. 5 with a further modified version of the substrate and resilient pad of FIG. 5.

FIG. 10 is a further repeat showing of FIG. 5 with a further modified version of the substrate and resilient pad of FIG. 5. Here, pad 74 of hanger 76 is configured to define sinuous path 78 between opposed margins of the pad. Substrate 72 of FIG. 9 is used in the FIG. 10 embodiment.

Various changes may be introduced in the disclosed preferred embodiments and practices without departing from the invention. By way of example, in the embodiment of FIGS. 1–5 , the resilient pad may be applied to one and not both of the substrate end portions. Accordingly, it is to be appreciated that the true spirit and scope of the invention is set forth in the following claims.

What is claimed is:

1. A hanger for jewelry, comprising a substrate having first and second end portions and first and second interior portions, said first end portion being foldable relative to said first interior portion, said second end portion being foldable relative to said second interior portion, said first and second interior portions being foldable relative to one another;

said substrate defining openings therethrough extending from a fold line of said first and second interior portions; and a first resilient pad adjacent first ends of said openings.

2. The hanger claimed in claim 1, wherein said hanger further includes a second resilient pad adjacent second ends of said openings.

3. The hanger claimed in claim 1, wherein said substrate defines an aperture extending through said first end portion adjacent a fold line of said first end portion and said first interior portion.

4. The hanger claimed in claim 1, wherein said substrate defines first and second slots adjacent free ends of said first and second end portions.

5. The hanger claimed in claim 1, wherein said substrate further includes an adhesive layer on a surface of one of said first and second end portions.

6. The hanger claimed in claim 1, wherein said substrate further includes an adhesive layer on a surface of one of said first and second interior portions.

7. A hanger for jewelry, comprising a substrate having first and second upstanding end portions and first and second upstanding interior portions and defining a first fold line between said first end portion and said first interior portion, a second fold line between said second end portion and said second interior portion and a third fold line between said first and second interior portions, said third fold line being disposed upwardly of said first and second fold lines;

said substrate defining openings extending through and downwardly of said third fold line; and a first resilient pad disposed between said first exterior portion and said first interior portion and a second resilient pad disposed between said second exterior portion and said second interior portion, said first and second resilient pads being downwardly of said openings.

8. The hanger claimed in claim 7, including an adhesive layer disposed between and joining said first and second interior portions.

9. The hanger claimed in claim 8, including a further adhesive layer disposed between and joining upper ends of said first and second exterior portions.

10. The hanger claimed in claim 7 wherein said substrate defines an aperture through said first end portion adjacent said first fold line.

11. The hanger claimed in claim 7, wherein said substrate defines first and second slots extending respectively through said first and second exterior portions and in registry with one another.

12. A hanger for supporting an elongate article comprising:

an elongate substance having a pair of opposed end extends;

a pair of lateral fold lines positioned inward of said end extents; and a central fold line positioned between said lateral fold lines and defining interior extents between each of said lateral fold lines and the central fold line;

a resilient pad supported by said interior extents;

said substrate being foldable about said central fold line to place said interior extents in mutual contact;

said substrate being further foldable about said lateral fold lines to place said end extents in mutual contact, with said interior extents positioned therebetween.

13. A hanger of claim 12 wherein said interior extents define an article support member.

14. A hanger of claim 13 wherein said pair of opposed end extents are adhesively attached.

* * * * *